US010265943B2

(12) United States Patent
Kuramoto et al.

(10) Patent No.: US 10,265,943 B2
(45) Date of Patent: Apr. 23, 2019

(54) FLEXOGRAPHIC PRINTING PLATE, ORIGINAL PLATE OF FLEXOGRAPHIC PRINTING PLATE, AND MANUFACTURING METHOD THEREFOR

(71) Applicant: FUJIFILM Corporation, Tokyo (JP)

(72) Inventors: Mamoru Kuramoto, Haibara-gun (JP); Yosuke Matsumoto, Haibara-gun (JP); Seiichiro Morikawa, Haibara-gun (JP)

(73) Assignee: FUJIFILM Corporation, Minato-Ku, Tokyo (JP)

( * ) Notice: Subject to any disclaimer, the term of this patent is extended or adjusted under 35 U.S.C. 154(b) by 0 days.

(21) Appl. No.: 15/856,973

(22) Filed: Dec. 28, 2017

(65) Prior Publication Data

US 2018/0141325 A1 May 24, 2018

Related U.S. Application Data

(63) Continuation of application No. PCT/JP2016/068239, filed on Jun. 20, 2016.

(30) Foreign Application Priority Data

Jun. 30, 2015 (JP) ..... 2015-131794
Feb. 23, 2016 (JP) ..... 2016-032024

(51) Int. Cl.
*B41C 1/05* (2006.01)
*B41F 5/24* (2006.01)
(Continued)

(52) U.S. Cl.
CPC ..... *B41C 1/05* (2013.01); *B41C 1/18* (2013.01); *B41F 5/24* (2013.01); *B41M 1/04* (2013.01);
(Continued)

(58) Field of Classification Search
CPC ..... B41N 1/04; B41N 1/06; B41F 5/24
See application file for complete search history.

(56) References Cited

U.S. PATENT DOCUMENTS

2004/0185188 A1* 9/2004 Amano ..... B41C 1/00 428/1.51
2005/0199145 A1 9/2005 Morimoto et al.
2010/0224091 A1 9/2010 Zwadlo

FOREIGN PATENT DOCUMENTS

EP 1 445 116 A2 8/2004
JP 7-228068 A 8/1995
(Continued)

OTHER PUBLICATIONS

Communication dated Jul. 4, 2018 from the European Patent Office in counterpart Application No. 16817756.6.
(Continued)

*Primary Examiner* — Leslie J Evanisko
*Assistant Examiner* — Quang X Nguyen
(74) *Attorney, Agent, or Firm* — Sughrue Mion, PLLC

(57) ABSTRACT

The present invention is to provide a flexographic printing plate having high ink transferability and making it possible to perform printing with a high ink density in a solid portion, a flexographic printing plate precursor, a method for manufacturing a flexographic printing plate, and a method for manufacturing a flexographic printing plate precursor. A flexographic printing plate of the present invention includes a relief layer including a non-image area and an image area having an uneven structure formed on a surface, in which the uneven structure is composed of recessed portions consisting of a plurality of grooves and projecting portions other than recessed portions, each of the plurality of grooves has a length of at least 30 μm, all of the plurality of grooves are grooves having a line edge roughness in a range of 0.5 to 2.5 μm in a region of 30 μm of the groove in a longitudinal
(Continued)

direction, a depth of the recessed portion is 5 to 25 μm, and a ratio of the projecting portion is 5% to 60% of a geometric area of the uneven structure.

18 Claims, 6 Drawing Sheets

(51) Int. Cl.

| | |
|---|---|
| ***B41N 1/12*** | (2006.01) |
| ***B41C 1/18*** | (2006.01) |
| ***B41M 1/04*** | (2006.01) |
| ***B41N 1/16*** | (2006.01) |
| ***B41N 1/22*** | (2006.01) |

(52) U.S. Cl.
CPC ..... *B41N 1/12* (2013.01); *B41N 1/16* (2013.01); *B41N 1/22* (2013.01); *B41P 2200/12* (2013.01)

(56) References Cited

FOREIGN PATENT DOCUMENTS

| | | | |
|---|---|---|---|
| JP | 2008-224784 | A | 9/2008 |
| JP | 2010-069836 | A | 4/2010 |
| WO | 2014/208374 | A1 | 12/2014 |

OTHER PUBLICATIONS

International Search Report for PCT/JP2016/068239 dated Sep. 6, 2016 [PCT/ISA/210].
International Preliminary Report on Patentability dated Jan. 2, 2018 issued by the International Bureau in International Application No. PCT/JP2016/068239.
Written Opinion dated Sep. 6, 2016 issued by the International Searching Authority in International Application No. PCT/JP2016/068239.

* cited by examiner

FLEXOGRAPHIC PRINTING PLATE, ORIGINAL PLATE OF FLEXOGRAPHIC PRINTING PLATE, AND MANUFACTURING METHOD THEREFOR

CROSS-REFERENCE TO RELATED APPLICATIONS

This application is a Continuation of PCT International Application No. PCT/JP2016/068239 filed on Jun. 20, 2016, which claims priority under 35 U.S.C. § 119(a) to Japanese Patent Application No. 2015-131794 filed on Jun. 30, 2015 and Japanese Patent Application No. 2016-032024 filed on Feb. 23, 2016. Each of the above applications is hereby expressly incorporated by reference, in its entirety, into the present application.

BACKGROUND OF THE INVENTION

1. Field of the Invention

The present invention relates to a flexographic printing plate, a flexographic printing plate precursor, a method for manufacturing a flexographic printing plate, and a method for manufacturing a flexographic printing plate precursor.

2. Description of the Related Art

A flexographic printing plate having a flexible relief forming layer made of resin or rubber has a relatively soft projecting portion (image area) for printing and can conform to various shapes. Therefore, a flexographic printing plate is used for printing performed on objects to be printed made of various materials, thick objects to be printed, and the like.

An image area of a flexographic printing plate is composed of a solid portion that is printed by filling the portion with ink by fully transferring the ink, and/or halftone dot portions consisting of a large number of small projecting dots expressing the gradation of an image printed on an object to be printed by changing the size or density of the small dots. A flexographic printing plate is placed on the peripheral surface of a cylindrical drum, and while a roller is being rotated, the flexographic printing plate is brought into contact with an object to be printed. In this manner, ink is directly transferred to the object to be printed from the surface of a projecting portion (image area) of the printing plate to form an image on the object to be printed.

In such a flexographic printing plate, there is a known problem of the occurrence of printing unevenness since a sufficient amount of ink cannot be transferred to the object to be printed in the solid portion depending on printing conditions such as printing pressure.

In order to solve such a problem, JP1995-228068A (JP-H07-228068A) discloses a printing plate in which a print point to which ink is transferred from a background screen for forming a pattern is covered by a fine screen ([claim 1]), and the surface of the print point of the background screen is enlarged by arranging the fine screen, and therefore a large amount of ink is attached to the screen point of the background screen so that the large amount of ink is transferred to an object to be printed ([0008]).

SUMMARY OF THE INVENTION

When conducting an investigation on the printing plate disclosed in JP1995-228068A (JP-H07-228068A), the present inventors have found that even in a case where a print point is covered by a fine screen, the ink transferability in a solid portion (particularly, a filled portion of a size of 1 mm square or more) cannot be sufficiently improved and the ink density is lowered.

An object of the present invention is to provide a flexographic printing plate having high ink transferability and making it possible to perform printing with a high ink density in a solid portion, a flexographic printing plate precursor, a method for manufacturing a flexographic printing plate, and a method for manufacturing a flexographic printing plate precursor.

As a result of conducting intensive research to solve the above problems, the present inventors have found that by controlling the line edge roughness of a plurality of grooves (groove lines) constituting recessed portions in a predetermined length region to be in a specific range or the like in an uneven structure which is formed on a surface of an image area, the ink transferability in the solid portion is improved and printing with a high ink density can be performed, and thus have completed the present invention.

That is, the present inventors have found that the above problem can be solved by the following configuration.

[1] A flexographic printing plate comprising: a relief layer including a non-image area and an image area having an uneven structure formed on a surface, in which the uneven structure is composed of recessed portions consisting of a plurality of grooves and projecting portions other than recessed portions, each of the plurality of grooves has a length of at least 30 μm, all of the plurality of grooves are grooves having a line edge roughness in a range of 0.5 to 2.5 μm in a region of 30 μm of the groove in a longitudinal direction, a depth of the recessed portion is 5 to 25 μm, and a ratio of the projecting portion is 5% to 60% of a geometric area of the uneven structure.

[2] The flexographic printing plate according to [1], in which all of the plurality of grooves are grooves having a line width roughness in a range of 0.8 to 4.0 μm in a region of 30 μm of the groove in a longitudinal direction.

[3] The flexographic printing plate according to [1] or [2], in which the plurality of grooves are grooves that are arranged parallel with each other or radially.

[4] A flexographic printing plate precursor comprising: a crosslinked relief forming layer having an uneven structure formed on a surface, in which the uneven structure is composed of recessed portions consisting of a plurality of grooves and projecting portions other than the recessed portions, each of the plurality of grooves has a length of at least 30 μm, all of the plurality of grooves are grooves having a line edge roughness in a range of 0.5 to 2.5 μm in a region of 30 μm of the groove in a longitudinal direction, a depth of the recessed portion is 5 to 25 μm, and a ratio of the projecting portion is 5% to 60% of a geometric area of the uneven structure.

[5] The flexographic printing plate precursor according to [4], in which all of the plurality of grooves are grooves having a line width roughness in a range of 0.8 to 4.0 μm in a region of 30 μm of the groove in a longitudinal direction.

[6] The flexographic printing plate precursor according to [5], in which the plurality of grooves are grooves that are arranged parallel with each other or radially.

[7] A method for manufacturing the flexographic printing plate having a relief layer including a non-image area and an image area having an uneven structure formed on a surface according to any one of [1] to [3], the method comprising: a layer forming step of forming a relief forming layer by using a resin composition for laser engraving; a crosslinking step of crosslinking the relief forming layer to obtain a flexographic printing plate precursor having a crosslinked relief forming layer; and an engraving step of performing laser engraving on the crosslinked relief forming layer to form the relief layer including the non-image area and the image area having the uneven structure formed on the surface, thereby obtaining the flexographic printing plate.

[8] A method for manufacturing the flexographic printing plate precursor having a crosslinked relief forming layer having an uneven structure formed on a surface according to any one of [4] to [6], the method comprising: a layer forming step of forming a relief forming layer by using a resin composition for laser engraving; a crosslinking step of crosslinking the relief forming layer to form the crosslinked relief forming layer; and an unevenness forming step of irradiating the crosslinked relief forming layer with laser light to form the uneven structure on the surface of the crosslinked relief forming layer, thereby obtaining the flexographic printing plate precursor.

[9] A method for manufacturing the flexographic printing plate having a relief layer including a non-image area and an image area having an uneven structure formed on a surface according to any one of [1] to [3], the method comprising: performing laser engraving on a crosslinked relief forming layer of a flexographic printing plate precursor produced by the method for manufacturing the flexographic printing plate precursor according to [8] to form the relief layer including the non-image area and the image area having the uneven structure formed on the surface, thereby obtaining the flexographic printing plate.

According to the present invention, it is possible to provide a flexographic printing plate having high ink transferability and making it possible to perform printing with a high ink density in a solid portion, a flexographic printing plate precursor, a method for manufacturing a flexographic printing plate, and a method for manufacturing a flexographic printing plate precursor.

DESCRIPTION OF THE PREFERRED EMBODIMENTS

Hereinafter, the present invention will be described in detail.

In the present invention, the notation "lower limit to upper limit", which expresses a numerical range, means "the lower limit or greater and the upper limit or less", and the notation "upper limit to lower limit" means "the upper limit or less and the lower limit or greater". That is, these are numerical ranges that include the upper limit and the lower limit.

In addition, the terms "parts by mass" and "% by mass" have the same meanings as the terms "parts by weight" and "% by weight", respectively.

Herein, regarding the description of a flexographic printing plate and a flexographic printing plate precursor, an uncrosslinked crosslinkable layer is referred to as "relief forming layer", a layer obtained by crosslinking the relief forming layer is referred to as "crosslinked relief forming layer", a layer in which a non-image area and an image area are formed on the surface by laser engraving is referred to as "relief layer".

In addition, the crosslinking is carried out by heat and/or light, and the crosslinking is not particularly limited as long as it is a reaction by which the resin composition is cured.

Further, a printing plate precursor having a crosslinked relief forming layer is laser-engraved and rinsed as desired to produce a flexographic printing plate.

[Flexographic Printing Plate]

A flexographic printing plate of the present invention is a flexographic printing plate having a relief layer including a non-image area and an image area having an uneven structure formed on the surface.

In addition, the uneven structure is composed of recessed portions consisting of a plurality of grooves, and projecting portions other than the recessed portions.

Each of the plurality of grooves has a length of at least 30 μm, and the line edge roughness in a region of 30 μm of the groove in a longitudinal direction is in a range of 0.5 to 2.5 μm.

The depth of the recessed portion is 5 to 25 μm.

The ratio of the projecting portion is 5% to 60% of a geometric area of the uneven structure.

Figure 5:
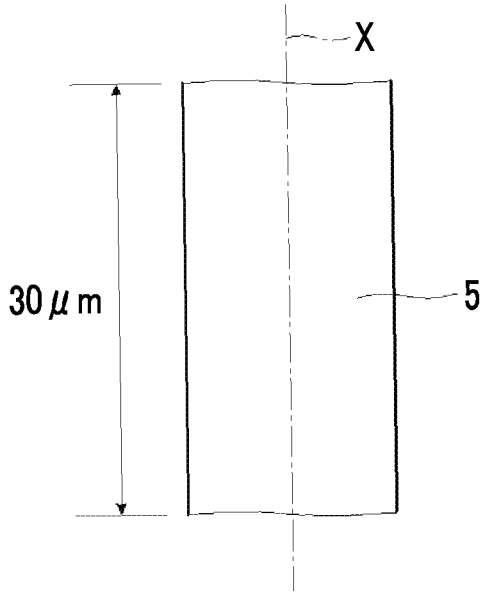
FIG. 5 is a schematic view for illustrating a center line in a recessed portion (groove) of an uneven structure.

Herein, the line edge roughness (hereinafter, also abbreviated as "LER") is a parameter showing a local fluctuation of a line constituting the edges of the grooves (the end portions of the recessed portions). In the specification, first, the uneven structure of the surface is measured with a 50 magnification lens using a hybrid laser microscope OPTELICS (registered trademark) HYBRID (manufactured by Lasertec Corporation) in 0.1 μm height increments to obtain three-dimensional data. Next, regarding the obtained three-dimensional data, a height lowered by 5 μm from an unengraved portion is set as a threshold value, the uneven structure is binarized by dividing the uneven structure into a portion having a height which is equal to or greater than the threshold value and a portion having a height which is smaller than threshold value, and these portions are defined as a projecting portion and a recessed portion. Then, a distance from the center line of the groove to the edge of the groove is measured at arbitrary 30 points included in a region of 30 μm in the longitudinal direction on the end portion of the recessed portion (edge of the groove), and a standard deviation of the distances is obtained to calculate a value of 3σ. The center line of the groove refers to a straight line (center line X) which is parallel with the longitudinal direction of the groove as shown in FIG. 5 and divides the bottom area of the groove of a recessed portion 5 in the measurement region in ½. However, in a case where there is no a straight line (a straight line which is parallel with the longitudinal direction of the groove) which divides the bottom area in ½, the center line of the groove refers to a straight line that can divide the bottom area in a value close to ½.

In addition, the line width roughness (hereinafter, also abbreviated as "LWR"), which will be described later, is a parameter showing a local fluctuation in the widths of the grooves. In the specification, first, the uneven structure of the surface is measured with a 50 magnification lens using a hybrid laser microscope OPTELICS (registered trademark) HYBRID (manufactured by Lasertec Corporation) in 0.1 μm height increments to obtain three-dimensional data. Next, regarding the obtained three-dimensional data, a height lowered by 5 μm from an unengraved portion is set as a threshold value, the uneven structure is binarized by dividing the uneven structure into a portion having a height which is equal to or greater than the threshold value and a portion having a height which is smaller than threshold value, and these portions are defined as a projecting portion and a recessed portion. The width of the groove is measured at arbitrary 30 points included in a region of 30 μm in the longitudinal direction on the end portion of the recessed portion (the edge of the groove) and the standard deviation of the widths is obtained to calculate a value of 3σ.

In addition, the geometric area of the uneven structure, which is a reference of the ratio of the projecting portion, refers to an area on the assumption that the uneven structure of the image area is a two-dimensional plane, and in the specification, the ratio of the projecting portion is a value obtained by calculating the ratio of the projecting portion with respect to the geometric area of a 100 μm square area according to the definition by the above-described binarization of the uneven structure.

According to the flexographic printing plate of the present invention having such a configuration, ink transferability is high in the solid portion and printing with a high ink density can be performed.

Although the details are not clear, the present inventors assume as follows.

When attempts have been made using the same method as a method for forming a relief layer in the related art in laser engraving at the time of forming the plurality of grooves on the surface of the image area, the present inventors have found that sufficient ink transferability is not always obtained.

The present inventors have considered that this is because in a case where grooves are unevenly formed on the surface or fine pores having a dot shape, instead of a groove shape, are formed, an improvement in ink transferability at a certain degree can be observed; however, in a case where the image area of the printing plate is separated from the object to be printed in a close contact state, the ink stays in the uneven portions or in the fine pores on the surface, and as a result, the ink is not uniformly transferred to the object to be printed.

Here, it has been considered that it is important to more uniformly transfer the ink in a case where the image area is separated from the object to be printed. In order to uniformly transfer ink, intensive research has been conducted not only on a method of simply controlling the roughness of the surface of the image area but also on an assumption that it is important to form ink flowing paths.

As a result, it has been found that by forming the recessed portions of the uneven structure like a river, in the case where the image area is separated from the object to be printed in a close contact state, it is preferable to form ink flowing paths. On the other hand, it has been found that slight backlash is caused on the side surfaces of grooves to be formed due to the component ratios in the main scanning direction and in the sub-scanning direction of laser light and this backlash adversely affects ink fluidity in a case where the image area is separated from the object to be printed.

Accordingly, in the present invention, it is considered that by controlling the LER of the plurality of grooves constituting the recessed portions to be in a predetermined range, in a case where the image area of the printing plate is separated from the object to be printed, the ink smoothly flows into the grooves, the ink is uniformly transferred to the object to be printed, and thus the density can be remarkably improved.

On the other hand, in order to obtain a sufficient printing density, it has been clarified that it is required to transfer ink to the object to be printed at a film thickness of about 5 to 10 μm. As a result of conducting an investigation on the depth of the recessed portion of the uneven structure in consideration of this finding, the present inventors have found that in a case where the depth of the recessed portion is 5 to 25 μm, the ink does not overflow from the grooves at the time of ink transfer, and fluidity can be secured without aggregation.

Next, the overall configuration of the flexographic printing plate of the present invention (particularly, the uneven structure formed on the surface of the image area) will be described using FIGS. 1 to 4B, and then each configuration will be described in detail.

Figure 1:
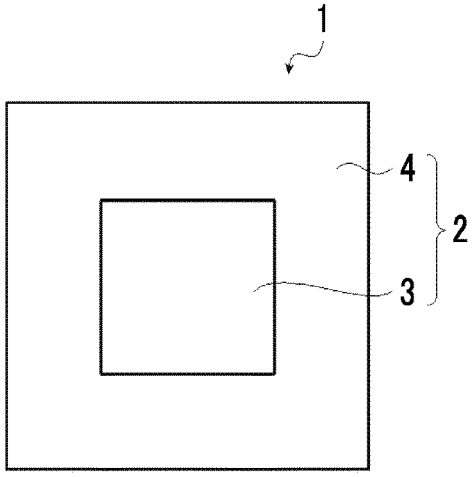
FIG. 1 is a schematic top view showing an example of a flexographic printing plate according to the present invention.

As shown in FIG. 1, a printing plate 1 as an example of the flexographic printing plate according to the present invention has a relief layer 2 on which an image area 3 and a non-image area 4 are formed.

The image area 3 is a region which is brought into contact with ink at the time of printing to transfer the ink to an object to be printed, that is, a region in which an image is formed at the time of printing. In addition, the non-image area 4 is a region which is not brought into contact with ink at the time of printing, that is, a region in which an image is not formed.

Figure 2:
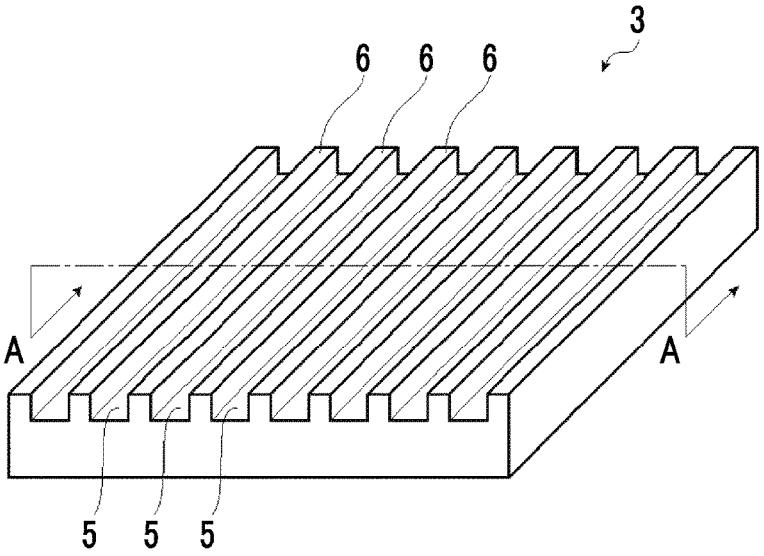
FIG. 2 is a schematic perspective view showing a part of an image area of the flexographic printing plate shown in FIG. 1 in an enlarged manner.
Figure 3:
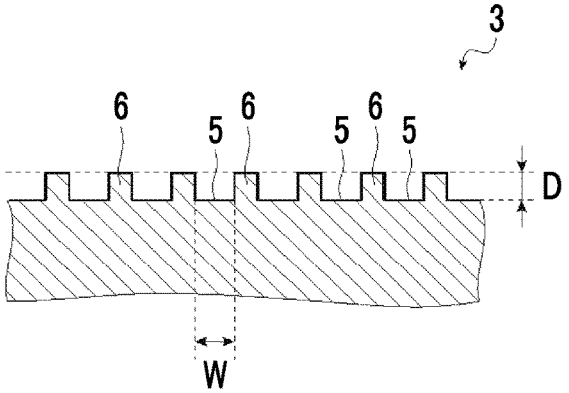
FIG. 3 is a cross-sectional view of the schematic perspective view shown in FIG. 2 taken along line A-A.

In addition, as shown in FIGS. 2 and 3, an uneven structure composed of recessed portions 5 consisting of a plurality of grooves and projecting portions 6 other than the recessed portions 5 is formed on the surface of the image area 3. Reference symbol D shown in FIG. 3 denotes the depth of the recessed portion 5 and reference symbol W denotes the width of the recessed portion 5.

Figure 4A:
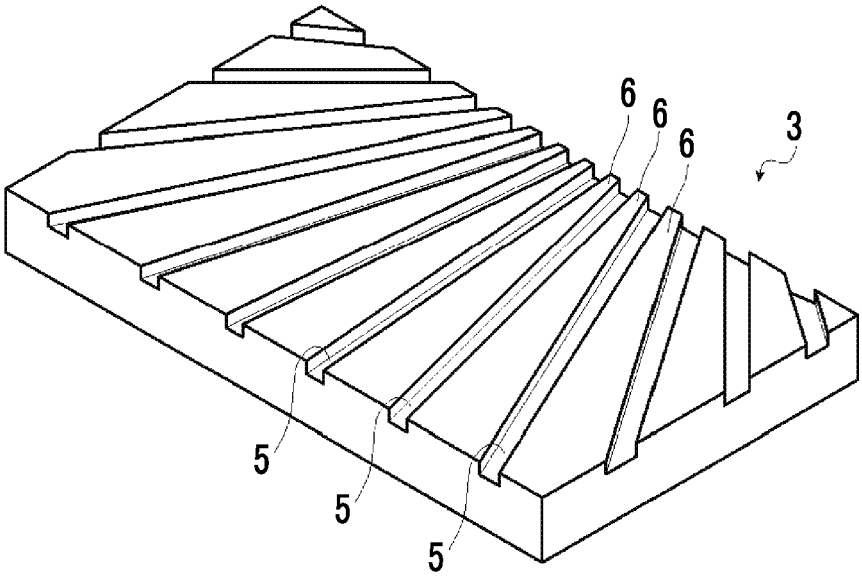
FIG. 4A is a schematic perspective view showing a part of an image area of another example of the flexographic printing plate according to the present invention.
Figure 4B:
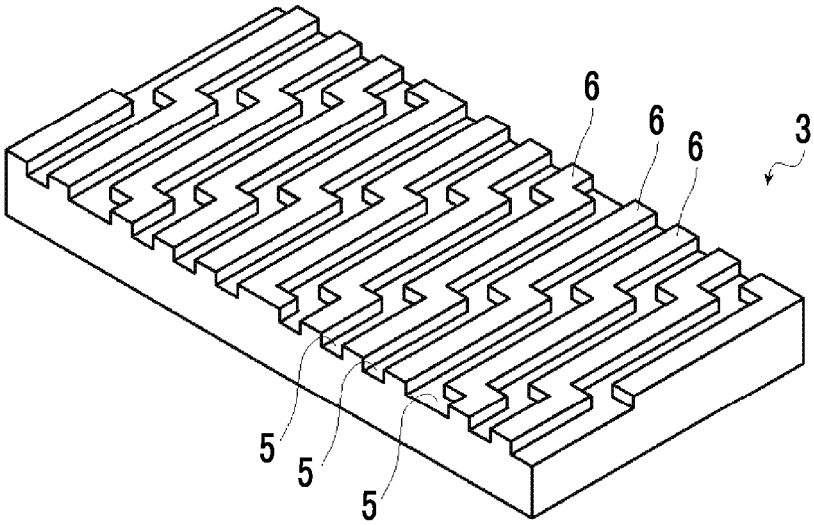
FIG. 4B is a schematic perspective view showing a part of an image area of still another example of the flexographic printing plate according to the present invention.

Further, in the recessed portions 5 consisting of the plurality of grooves, as long as the LER in a region of 30 μm in each groove in the longitudinal direction satisfies a range of 0.5 to 2.5 μm, as shown in FIG. 2, each of the grooves may be arranged parallel with each other, as shown in FIG. 4A, each of the grooves may be radially arranged, or as shown in FIG. 4B, each of the grooves may be bent to have two or more straight line portions.

[Uneven Structure]

The uneven structure formed on the surface of the image area is composed of recessed portions consisting of a plurality of grooves and projecting portions other than the recessed portion, as described above.

<Recessed Portions (Plurality of Grooves)>

All of the plurality of grooves constituting the uneven structure have a length of at least 30 μm, preferably have a length of 50 μm or more, and more preferably have a length of 100 μm or more. The upper limit of the length is not limited. However, the upper limit thereof is preferably 1,000 μm or less from the viewpoint of practical use.

Herein, the expression "have a length of at least 30 μm" means that the length includes at least a region (30 μm in the longitudinal direction) in which the LER is measured, and for example, a groove having a LER in a range of 0.5 to 2.5 μm is excluded only in a short region of about 10 μm.

In the present invention, as long as a plurality of grooves, each of which has a length of at least 30 μm and a line edge roughness in a range of 0.5 to 2.5 μm in a region of 30 μm of the groove in the longitudinal direction (hereinafter, also referred to as "specific groove" in the paragraph), are provided, as shown in FIG. 4B, the plurality of specific grooves by grooves other than specific grooves may be connected to each other or the plurality of specific grooves may be connected to each other in a vertical direction.

In addition, as described above, all of the plurality of grooves are grooves having a LER in a range of 0.5 to 2.5 μm in the region of 30 μm of the groove in the longitudinal direction. However, for the reason that printing can be performed with a higher high ink density by smoothly transferring the ink in the solid portion to the object to be printed, a groove having a LER in a range of 0.9 to 2.0 μm is preferable and a groove having a LER in a range of 1.0 to 1.5 μm is more preferable.

Further, in the plurality of grooves, the depth of the recessed portion (a portion denoted by reference symbol D in FIG. 3) is 5 to 25 μm. However, for the reason that printing can be performed with a higher high ink density by smoothly transferring the ink in the solid portion to the object to be printed, a groove in which the depth of the recessed portion is 10 to 22 μm is preferable and a groove in which the depth of the recessed portion is 15 to 20 μm is more preferable.

In the plurality of grooves, for the reason that printing can be performed with a higher high ink density by smoothly transferring the ink in the solid portion to the object to be printed, the width of the recessed portion (a portion denoted by reference symbol W in FIG. 3) is preferably 5 to 30 μm and the width of the recessed portion is more preferably 10 to 25 μm.

In the present invention, for the reason that printing can be performed with a higher high ink density by smoothly transferring the ink in the solid portion to the object to be printed, all of the plurality of grooves are preferably grooves having a line width roughness (LWR) in a range of 0.8 to 4.0 μm in a region of 30 μm of the groove in the longitudinal direction, more preferably grooves having a LWR in a range of 1.0 to 3.0 μm, and even more preferably grooves having a LWR in a range of 1.3 to 2.3 μm.

In the present invention, for the reason that printing can be performed with a higher high ink density by transferring ink without allowing the grooves to interfere with each other and without disorder, the plurality of grooves are preferably grooves that are arranged parallel with each other or radially, and more preferably grooves are grooves that are arranged parallel with each other.

<Projecting Portions>

The projecting portions constituting the uneven structure refer to portions other than the recessed portions in the image area as described above.

Herein, the shape of the projecting portion is not particularly limited as long as the recessed portions other than the projecting portions satisfy the above-described configuration, and examples thereof include a rectangular shape shown in FIG. 2, a trapezoidal shape shown in FIG. 4A, and a shape formed by combining two or more rectangular shape shown in FIG. 4B.

In addition, for the reason that printing can be performed with a higher high ink density by holding the shape of the groove of the recessed portion from printing pressure at the time of transferring ink and securing a large number of ink flowing paths, the width of the projecting portion of the projecting portion is preferably 1 to 25 μm, and the width of the recessed portion is more preferably 5 to 15 μm.

In the present invention, the ratio of the projecting portion constituting the uneven structure is 5% to 60% of the geometric area of the uneven structure as described above. However, for the reason that printing can be performed with a higher high ink density by holding the shape of the groove of the recessed portion from printing pressure at the time of transferring ink and securing a large number of ink flowing paths, the ratio thereof is preferably 10% to 40% and more preferably 15% to 30%.

[Flexographic Printing Plate Precursor]

A flexographic printing plate precursor of the present invention is a flexographic printing plate precursor having a crosslinked relief forming layer having an uneven structure formed on the surface.

In addition, the uneven structure is composed of recessed portions consisting of a plurality of grooves and projecting portions other than recessed portions.

In addition, each of the plurality of grooves is a groove having a length of at least 30 μm and the LER in a region of 30 μm of the groove in the longitudinal direction is in a range of 0.5 to 2.5 μm.

In addition, the depth of the recessed portion is 5 to 25 μm.

Further, the ratio of the projecting portion is 5% to 60% of the geometric area of the uneven structure.

The flexographic printing plate precursor of the present invention is the same as the known flexographic printing plate precursor except that the crosslinked relief forming layer has an uneven structure on its surface. In addition, the printing plate precursor may have a sheet-like shape or a cylindrical shape.

Herein, as described above, the crosslinked relief forming layer is a layer before laser engraving is performed and is a layer for forming a relief layer having an image area and a non-image area by laser-engraving the crosslinked relief forming layer to remove a region corresponding to the non-image area. Therefore, the surface of the relief forming layer of the printing plate precursor of the present invention becomes the surface of the image area of the above-described flexographic printing plate of the present invention after laser engraving.

That is, the crosslinked relief forming layer of the printing plate precursor of the present invention has an uneven structure which is the same as the uneven structure formed on the surface of the image area of the above-described flexographic printing plate on its surface.

Accordingly, the description of the uneven structure formed on the surface of the crosslinked relief forming layer of the printing plate precursor of the present invention is omitted.

The flexographic printing plate precursor of the present invention may have a support on a rear surface of the crosslinked relief forming layer (the surface on the opposite to the engraved surface).

Although such a support is not particularly limited, a support having high dimensional stability is preferable. Examples thereof include polyester (for example, polyethylene terephthalate (PET), polybutylene terephthalate (PBT), polyethylene naphthalate (PEN)); polyacrylonitrile (PAN); polyimide (PI); polyamide (PA); fluororesin such as Teflon (registered trademark); plastic resin such as silicone resin or polyvinyl chloride; synthetic rubber such as styrene-butadiene rubber; and plastic resin reinforced with glass fibers (such as epoxy resin or phenol resin).

As the support, a PET film, a PEN film, a PI film, a PA film, a fluororesin film, or a silicone resin film is preferably used.

[Method for Manufacturing Flexographic Printing Plate (First Aspect)]

A method for manufacturing a flexographic printing plate according to a first aspect of the present invention (hereinafter, also referred to as "first printing plate manufacturing method") is a method for manufacturing the above-described flexographic printing plate of the present invention, and the method includes a layer forming step of forming a relief forming layer by using a resin composition for laser engraving, a crosslinking step of crosslinking the relief forming layer to obtain a flexographic printing plate precursor having a crosslinked relief forming layer, and an engraving step of performing laser engraving on the crosslinked relief forming layer to form the relief layer including the non-image area and the image area having the uneven structure formed on the surface, thereby obtaining the flexographic printing plate.

A method for manufacturing a flexographic printing plate according to a second aspect of the present invention, which will be described later, is a method for manufacturing a flexographic printing plate by using a flexographic printing plate precursor manufactured by a method for manufacturing a flexographic printing plate precursor, which will be described later.

Hereinafter, each step of the first printing plate manufacturing method will be described in detail.

[Layer Forming Step]

The layer forming step is a step of forming a relief forming layer before crosslinking (before curing) by using a resin composition for laser engraving (hereinafter, also simply referred to as "resin composition").

<Resin Composition>

As the resin composition, a known resin composition in the related art for forming a relief forming layer of a flexographic printing plate precursor can be used, and for example, a resin composition containing a diene-based polymer, a thermal polymerization initiator, and carbon black may be used.

Next, each component contained in the resin composition used in the layer forming step will be described.

(Diene-Based Polymer)

The diene-based polymer is not particularly limited and any known diene-based polymer in the related art can be used without limitations.

Specific examples of the diene-based polymer include polyisoprene, polybutadiene, an ethylene-propylene-diene copolymer (EPDM), an acrylonitrile-butadiene copolymer, a styrene-butadiene copolymer (SBR), a styrene-isoprene copolymer, and a styrene-isoprene-butadiene copolymer, and these may be used singly or in combination of two or more kinds thereof.

Among these, for the reason that the variation in the film thickness of the relief forming layer is decreased, the diene-based polymer is preferably at least one diene-based polymer selected from the group consisting of polyisoprene, polybutadiene, and an ethylene-propylene-diene copolymer.

In the present invention, the weight-average molecular weight of the diene-based polymer is preferably 200,000 or more, more preferably 300,000 to 2,000,000, even more preferably 300,000 to 1,500,000, and particularly preferably 300,000 to 700,000 from the viewpoint of the tensile strength of the relief forming layer.

Here, the weight-average molecular weight can be determined by measuring the molecular weight by gel permeation chromatography (GPC) and calculating the weight-average molecular weight relative to polystyrene standards. Specifically, for example, regarding GPC, HLC-8220GPC (manufactured by Tosoh Corporation) is used, and three columns of TSKgeL Super HZM-H, TSKgeL Super HZ4000, and TSKgeL SuperHZ2000 (manufactured by Tosoh Corporation, 4.6 mm ID×15 cm) are used, while tetrahydrofuran (THF) is used as an eluent. Further, regarding the conditions, GPC is performed using an IR detector under the conditions of a sample concentration of 0.35% by mass, a flow rate of 0.35 mL/min, a sample injection amount of 10 μL, and a measurement temperature of 40° C. Also, the detection curve is produced using eight samples of "standard sample TSK standard, polystyrene": "F-40", "F-20", "F-4", "F-1", "A-5000", "A-2500", "A-1000", and "n-propylbenzene".

The content of the diene-based polymer in the resin composition is preferably 5% to 90% by mass, more preferably 15% to 85% by mass, and even more preferably 30% to 85% by mass with respect to the total solid content. In the case in which the content of the diene-based polymer is in the above range, a relief layer having further excellent rinsability of the engraving residue and excellent ink transferability may be obtained, which is preferable.

(Thermal Polymerization Initiator)

The thermal polymerization initiator is not particularly limited, and any known thermal polymerization initiator in the related art (for example, a radical polymerization initiator) can be used without limitations.

Specific examples of the thermal polymerization initiator include: (a) an aromatic ketone, (b) an onium salt compound, (c) an organic peroxide, (d) a thio compound, (e) a hexaarylbiimidazole compound, (f) a keto oxime ester compound, (g) a borate compound, (h) an azinium compound, (i) a metallocene compound, (j) an active ester compound, (k) a compound having a carbon-halogen bond, and (l) an azo-based compound, and these may be used singly or in combination of two or more kinds thereof.

Among these, for the reason that the half-life temperature is high, and consequently scorching (early curing) at the time of kneading of the resin composition can be suppressed, or for the reason that satisfactory engraving sensitivity is obtained, and a satisfactory relief edge shape is obtained in the case in which the resin composition is applied to the relief forming layer of the flexographic printing plate precursor, the (c) organic peroxide is particularly preferable.

Here, regarding the (a) aromatic ketone, (b) onium salt compound, (d) thio compound, (e) hexaarylbiimidazole compound, (f) keto oxime ester compound, (g) borate compound, (h) azinium compound, (i) metallocene compound, (j) active ester compound, (k) compound having a carbon-halogen bond, and (l) azo-based compound, the compounds described in paragraphs "0074" to "0118" of JP2008-63554A can be preferably used.

On the other hand, regarding the (c) organic peroxide mentioned as suitable examples, the compounds described below are preferable.

Specific examples of the organic peroxide include dicumyl peroxide (10-hour half-life temperature: 116° C.), α,α'-di(t-butylperoxy)diisopropylbenzene (10-hour half-life temperature: 119° C.), and 2,5-dimethyl-2,5-di(t-butylperoxy)hexane (10-hour half-life temperature: 118° C.), and these may be used singly or in combination of two or more kinds thereof.

In the present invention, regarding the form of the organic peroxide, the organic peroxide can be used as a technical product as it is; however, from the viewpoint of handleability problems (hazardousness, workability, and the like), a dilution product at a concentration of 40 wt % (non-hazardous, powdered) in which a technical product is adsorbed to an inorganic filler such as calcium carbonate, or a master batch type dilution product intended to prevent dusting at the time of kneading and to improve dispersibility in the polymer, can be more preferably used.

Regarding the technical product, for example, PERCUMYL D (manufactured by NOF Corporation), PERKADOX BC-FF (manufactured by Kayaku Akzo Corporation), LUPEROX DC (manufactured by Arkema Yoshitomi, Ltd.), PERBUTYL P (manufactured by NOF Corporation), PERKADOX 14 (manufactured by Kayaku Akzo Corporation), LUPEROX F (manufactured by Arkema Yoshitomi, Ltd.), LUPEROX F90P (manufactured by Arkema Yoshitomi, Ltd.), PERHEXA 25B (manufactured by NOF Corporation), KAYAHEXA AD (manufactured by Kayaku Akzo Corporation), and LUPEROX 101 (manufactured by Arkema Yoshitomi, Ltd.) can be used; however, the examples are not intended to be limited to these.

Furthermore, examples of dilution products include PERCUMYL D-40 (manufactured by NOF Corporation; inert filler dilution product), PERCUMYL D-40MB (manufactured by NOF Corporation; dilution product of silica/polymer and others), KAYACUMYL D-40C (manufactured by Kayaku Akzo Corporation; calcium carbonate dilution product), KAYACUMYL D-40MB-S (manufactured by Kayaku Akzo Corporation; rubber master batch), KAYACUMYL D-40MB (manufactured by Kayaku Akzo Corporation; rubber master batch), PERBUTYL P-40 (manufactured by NOF Corporation; inert filler dilution product), PERBUTYL P-40MB (manufactured by NOF Corporation; dilution product of silica/polymer and others), PERKADOX 14/40 (manufactured by Kayaku Akzo Corporation; calcium carbonate dilution product), PERKADOX 14-40C (manufactured by Kayaku Akzo Corporation; calcium carbonate dilution product), LUPEROX F40 (manufactured by Arkema Yoshitomi, Ltd.), PERHEXA 25B-40 (manufactured by NOF Corporation; dilution product of silica and others), KAYAHEXA AD-40C (manufactured by Kayaku Akzo Corporation; calcium silicate dilution product), TRIGONOX 101-40MB (manufactured by Kayaku Akzo Corporation; rubber master batch), and LUPEROX 101XL (manufactured by Arkema Yoshitomi, Ltd.) can be used; however, the examples are not intended to be limited to these.

In the present invention, the amount of the thermal polymerization initiator is preferably 0.1 to 20.0 parts by mass, more preferably 0.5 to 15.0 parts by mass, and even more preferably 1.0 to 15.0 parts by mass with respect to 100 parts by mass of the diene-based polymer for the reason that excellent rinsability of the engraving residue and satisfactory printing durability and ink receptivity are obtained.

(Carbon Black)

The carbon black included is not particularly limited, and as long as dispersibility thereof in the resin composition and the like are stable, any carbon black can be used regardless of the classification by American Society for Testing and Materials (ASTM) and the applications (for example, color applications, rubber applications, and battery applications).

Here, in the present invention, it is considered that carbon black functions as a photothermal conversion agent that accelerates thermal decomposition of a cured product at the time of laser engraving by absorbing laser light and generating heat.

Specific examples of carbon black include furnace black, thermal black, channel black, lamp black, and acetylene black, and these may be used singly or in combination of two or more kinds thereof.

Meanwhile, these carbon blacks can be used as color chips or color pastes, in which carbon blacks have been dispersed in nitrocellulose, a binder or the like in advance using a dispersant as necessary to facilitate dispersion. However, from the viewpoint of cost, it is preferable to use carbon blacks as powders.

In the present invention, the content of carbon black is preferably 1 to 30 parts by mass, more preferably 2 to 25 parts by mass, and particularly preferably 3 to 20 parts by mass with respect to 100 parts by mass of the diene-based polymer for the reason that satisfactory sensitivity is obtained at the time of laser engraving, and satisfactory ink receptivity is obtained.

(Other Additives)

In the resin composition used in the layer forming step, various known additives can be appropriately incorporated to the extent that the effects of the present invention are not impaired. Examples thereof include a crosslinking aid, a silane coupling agent, another filler, a wax, a process oil, a metal oxide, an ozone decomposition preventing agent, an aging inhibitor, a polymerization inhibitor and a colorant, and these may be used singly or in combination of two or more kinds thereof.

(Formation Method)

Figure 6:
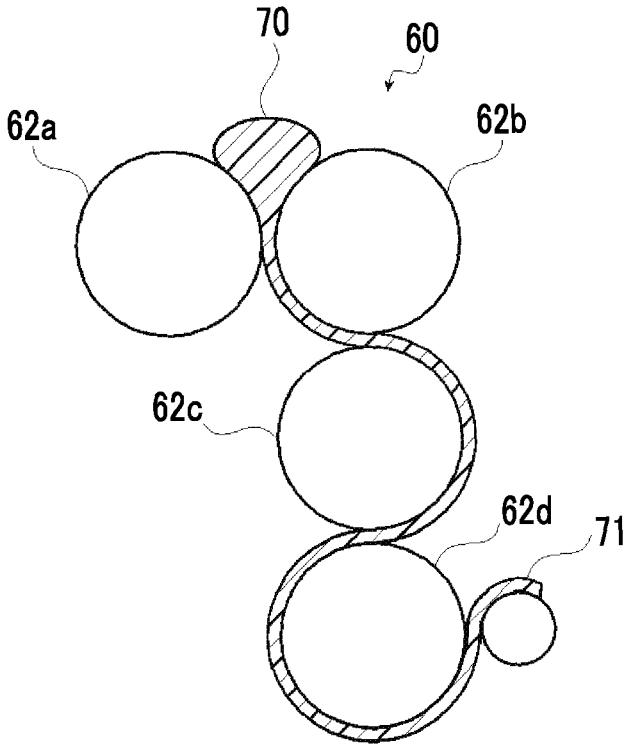
FIG. 6 is a view conceptually showing a calender roll for producing a flexographic printing plate precursor.

As a method for forming the relief forming layer, for example, a method including preparing a resin composition, removing a solvent from the resin composition as required, and then melting and extruding the resin composition on a support; a method including a preparing a resin composition, casting the resin composition on a support, and heating and drying the resin composition in an oven or the like to remove a solvent; a method including molding a resin composition into a sheet shape using a calender roll as shown in FIG. 6, or the like can be suitably used.

In FIG. 6, a calender roll 60 has first roll 62*a* to fourth roll 62*d*, and intervals of these rolls, the temperature of these rolls, and the rotation speed of these rolls can be set.

A sheet-like uncured layer 71 can be obtained by setting a kneaded product 70 of the resin composition between the rolls and rolling and molding the material.

In the present invention, the relief forming layer may be composed of a plurality of layers from the viewpoint of improving printing image quality, and may be composed of, for example, three layers of an outermost layer, an interlayer, and an underlayer.

Herein, the outermost layer of the relief forming layer is preferably formed by using a low hardness resin from the viewpoint of further increasing the ink density in the solid portion by improving the shape followability of a printing medium. Specifically, it is preferable to use a resin having a Martens hardness of 3 $N/mm^2$ or less at the time of 1 μm pushing and it is more preferable to use a resin having a Martens hardness of 2 $N/mm^2$ or less at the time of 1 μm pushing.

In addition, the thickness of the outermost layer is preferably 30 μm or less and 10 μm or more and more preferably 20 μm or less and 10 μm or more.

As the resin constituting the outermost layer, the above-described diene-based polymer can be used.

In addition, the interlayer of the relief forming layer is preferably a hard layer from the viewpoint of suppressing deformation of halftone dots.

The Martens hardness of the interlayer at the time of 1 μm pushing is preferably 10 $N/mm^2$ or more and more preferably 20 $N/mm^2$ or more from the viewpoint of the printing quality of a highlight region. In addition, the hardness of the interlayer is preferably 100 $N/mm^2$ or less from the viewpoint of film formation suitability and durability.

The thickness of the interlayer is preferably 80 μm or more and 300 μm or less and more preferably 100 μm or more and 200 μm or less from the viewpoint of the printing quality of a highlight region.

The resin constituting the interlayer is not particularly limited but from the viewpoint of hardness and durability, a crystalline polymer is preferably used.

Herein, the term "crystalline polymer" means a polymer having a molecular structure in which crystalline regions in which long-chain molecules are regularly arranged and amorphous regions in which long-chain molecules are not regularly arranged are mixed in the molecular structure, and refers to a polymer having a crystallinity of 1 vol % or more, which is the ratio of the crystalline region, at 25 degrees.

In addition, regarding the crystallinity, while the temperature is being changed with a differential scanning calorimeter at a temperature rising rate of 20° C./min in a range of 25° C. to 200° C. in a nitrogen atmosphere, a heat absorption peak (ΔH (J/g)) by crystal melting is obtained. Based on the measured ΔH, a reaching crystallinity (%) is calculated by the following equation.

$$\text{Crystallinity (\%)}=\{\Delta H/a\}\times 100$$

In the equation, "a" denotes a heat of crystal melting in a case where the component of the crystalline region shown in a known document is 100% crystallized (for example, in a case of polylactic acid, 94 J/g, and in a case of polyethylene (HDPE), 293 (J/g)).

Examples of such a crystalline polymer include a polybutadiene-based thermoplastic elastomer, and a polyolefin-based thermoplastic elastomer.

Specific examples thereof include polystyrene-polybutadiene (SB), polystyrene-polybutadiene-polystyrene (SBS), polystyrene-polyisoprene-polystyrene (SIS), polystyrene-polyethylene/polybutylene-polystyrene (SEBS), an acrylonitrile-butadiene-styrene copolymer (ABS), acrylic ester rubber (ACM), an acrylonitrile-chlorinated polyethylene-styrene copolymer (ACS), amorphous polyalphaolefin, atactic polypropylene, an acrylonitrile styrene copolymer, cellulose acetate butyrate, cellulose acetate propionate, an ethylene-vinyl acetate copolymer, ethyl vinyl ether, polyacrylic acid, polypropylene, syndiotactic 1,2-polybutadiene, polyisoprene, polyoctenylene, trans-polyisoprene, polyvinyl butyral, an ethylene-α-olefin copolymer such as an ethylene-octene copolymer, a propylene-α-olefin copolymer, and a 1,3-pentadiene polymer.

Among these, SBS, SIS, SEBS, polypropylene, syndiotactic 1,2-polybutadiene, polyisoprene, polyoctenylene, trans-polyisoprene, an ethylene-α-olefin copolymer such as an ethylene-octene copolymer, and a propylene-α-olefin copolymer are preferable and among these, syndiotactic 1,2-polybutadiene, an ethylene-α-olefin copolymer, a propylene-α-olefin copolymer, and polyoctenylene are particularly preferable.

The content of the crystalline polymer in the resin composition is preferably 5% to 90% by mass, more preferably 15% to 85% by mass, and even more preferably 30% to 85% by mass with respect to the total solid content. In a case where the content of the crystalline polymer is in the above range, the rinsability of engraving residue is excellent and ink transferability is further excellent. Thus, this case is preferable.

In addition, the underlayer of the relief forming layer is preferably a soft layer from the viewpoint of securing the drape properties of the plate.

The Martens hardness of the underlayer at the time of 1 μm pushing is preferably 0.1 $N/mm^2$ or more and 5 $N/mm^2$ or less and more preferably 1 $N/mm^2$ or more and 4 $N/mm^2$ or less from the viewpoint of a balance between drape properties and printing image quality.

In addition, the thickness of the underlayer is preferably 0.5 mm or more and 2 mm or less and more preferably 0.6 mm or more and 1 mm or less from the viewpoint of a balance between drape properties and printing image quality.

As the resin constituting the underlayer, the above-described diene-based polymer can be used.

[Crosslinking Step]

The crosslinking step is a step of crosslinking the relief forming layer formed in the above layer forming step to form a crosslinked relief forming layer.

Herein, the crosslinking method is not particularly limited as long as the method is a method for curing the relief forming layer by light and/or heat. Curing methods used in methods for manufacturing a flexographic printing plate precursor in the related art can be appropriately used.

(Photocuring)

In a case where the relief forming layer contains a photopolymerization initiator, the relief forming layer can be crosslinked by irradiating the relief forming layer with light (hereinafter, also referred to as "actinic ray") which becomes a trigger for the photopolymerization initiator.

The irradiation with the actinic ray is generally performed over the entire surface of the relief forming layer.

Examples of the actinic ray include visible light, ultraviolet light, and an electron beam but ultraviolet light is most generally used. In a case where a base material side for fixing a relief forming layer such as a support of the relief forming layer is taken as a rear surface, only a front surface of the support may be irradiated with light. However, it is preferable to perform irradiation with light from the rear surface as well as from the front surface in a case where the support is a transparent film which transmits an actinic ray. In a case where a protective film is present, the irradiation from the front surface may be performed with the protective film being provided, or may be performed after the protective film is removed. Since there is a concern of causing a polymerization inhibition under the presence of oxygen, the irradiation with actinic ray may be performed after coating the relief forming layer with a vinyl chloride sheet under vacuum.

(Thermosetting)

In a case where the relief forming layer contains a thermal polymerization initiator, the relief forming layer can be crosslinked by heating.

As heating means for performing crosslinking by heat, a method of heating an uncured layer in a hot air oven or a far-infrared oven for a predetermined period of time and a method of bringing a heated roll into contact with an uncured layer for a predetermined period of time may be used.

As the method for curing the relief forming layer, the relief forming layer is preferably crosslinked by heat from the viewpoint that uniform curing (crosslinking) is possible from the surface to the inside.

In a case where the relief forming layer is crosslinked by heat, there are advantages in that, first, a relief formed after laser engraving is made sharp and, second, the stickiness of engraving residue generated during the laser engraving is suppressed.

[Engraving Step]

The engraving step is a step of forming a relief layer including a non-image area and an image area having the above-described uneven structure formed on the surface by performing laser engraving on the crosslinked relief forming layer which is crosslinked in the above crosslinking step.

The laser engraving method is not particularly limited. However, in the first printing plate manufacturing method, it is required to perform engraving on a portion which becomes the non-image area (to form the non-image area) and to form the above-described uneven structure on the surface of the image area. Thus, a method of controlling a laser head by a computer based on digital data of a desired image and performing scanning and irradiation on the crosslinked relief forming layer is preferably used.

(Image Data Generation Method)

As the method for generating image data for laser engraving, the following method can be used.

First, original image data of a printing plate to be produced is obtained. Next, in order to convert the original image data into data for performing laser engraving, processing using Raster Image Processor (RIP) is performed. On the other hand, by rasterizing the original image data, a plurality of partial regions having a predetermined width measured from the outer periphery (edge) of each image area is extracted. On each of the extracted partial regions, a template having recessed patterns with a predetermined area ratio is superimposed, thereby forming a mask. Further, the image data which had been subjected to RIP processing is multiplied by the generated mask to generate output image data.

In this manner, the output image data is generated by adding the recessed patterns to the image area of the original image data as shown in FIGS. 8A to 8F, and laser engraving is performed using the output image data to produce a flexographic printing plate.

(Laser Engraving)

As the method for laser engraving, for example, a method in which a sheet-like printing plate precursor for laser engraving is twined around the outer peripheral surface of a drum having a cylindrical shape, the drum is rotated, an exposure head is caused to perform scanning on the printing plate precursor in a sub-scanning direction orthogonal to a main scanning direction at a predetermined pitch by emitting laser light according to the output image date from the exposure head to the printing plate precursor such that a two-dimensional image is engraved (recorded) on the surface of the printing plate precursor at a high speed, and the like can be used.

In the present invention, for the reason that a groove having a LER in a range of 0.5 to 2.5 μm in a region of 30 μm in the longitudinal direction can be easily formed, in a case where the length of a groove which is formed by continuous irradiation with laser in the main scanning direction is set to A, and the length of a groove which is formed by continuous irradiation with laser in the sub-scanning direction is set to B at the time of forming the uneven structure (plurality of grooves), the uneven structure is preferably formed under the condition that A is three or more times longer than B, or the condition that only A is provided.

The kind of laser used in the laser engraving is not particularly limited but infrared laser is preferably used. In a case where irradiation is performed with infrared laser, the molecules in the crosslinked relief forming layer are vibrated to generate heat. In a case where high output laser such as carbon dioxide gas laser or yttrium aluminum garnet (YAG) laser is used as infrared laser, a large amount of heat is generated in the laser irradiation portion, the molecules in the cured layer are cut or ionized, and thereby, selective removal, that is, engraving is implemented.

From the viewpoint of productivity, costs and the like, as infrared laser, carbon dioxide gas laser ($CO_2$ laser) or semiconductor laser is preferable, and semiconductor infrared laser with fiber (FC-LD) is particularly preferable. Generally, semiconductor laser has a higher efficiency of laser oscillation, and is inexpensive as compared with $CO_2$ laser, and can be miniaturized. In addition, since the semiconductor laser is small, it may be easily arrayed. Further, the shape of a beam can be easily controlled by treatment of the fiber.

With regard to the semiconductor laser, one having a wavelength of 700 to 1,300 nm is preferable, one having a wavelength of 800 to 1,200 nm is more preferable, one having a wavelength of 860 to 1,200 nm is future preferable, and one having a wavelength of 900 to 1,100 nm is particularly preferable.

In addition, the semiconductor infrared laser with fiber can output laser light efficiently by being equipped with optical fiber, and thus this is effective in the laser engraving. Further, the shape of the beam can be controlled by treatment of the fiber. For example, the beam profile may be a top hat shape, and energy can be applied stably to the plate surface. The details of semiconductor lasers are described in "Laser Handbook 2nd Edition" edited by The Laser Society of Japan, "Applied Laser Technology" edited by The Institute of Electronics and Communication Engineers of Japan., etc.

Moreover, plate producing apparatuses including semiconductor laser composed of fiber described in detail in JP2009-172658A and JP2009-214334A can be suitably used for the method for manufacture a flexographic printing plate of the present invention.

The present invention is not limited to the above-described laser engraving (direct laser engraving (DLE) system) and various known manufacturing methods such as a laser ablation masking system (LAMS) for writing an image on the surface of a printing plate precursor with laser and developing the image can be used.

[Rinsing Step]

The first printing plate manufacturing method of the present invention may include a rinsing step of rinsing the engraved surface with an aqueous alkali solution, after the engraving step. By providing the rinsing step, the engraving residue adhering to and remaining on the engraved surface can be removed by washing away.

Examples of the means for rinsing include a method of immersing the printing plate in an aqueous alkali solution; a method of rotating the rinsing liquid or rubbing the engraved surface with a brush, while immersing the printing plate in an aqueous alkali solution; a method of spraying an aqueous alkali solution; and a method of rubbing the engraved surface with a brush mainly in the presence of an aqueous alkali solution, using a batch type or conveyor type brush washing machine which is known as a developing machine for photosensitive resin relief printing plates. In the case in which the slime of the engraving residue cannot be removed, a rinsing liquid containing soap or a surfactant may be used.

[Drying Step]

In the first printing plate manufacturing method of the present invention, in the case of performing the rinsing step of rinsing the engraved surface, after the engraving step, a drying step of volatilizing the rinsing liquid by drying the engraved relief forming layer may be added.

[Post-Crosslinking Step]

In the first printing plate manufacturing method of the present invention, as required, after the engraving step, a post-crosslinking step of further crosslinking the relief layer may be added. By carrying out a post-crosslinking step, which is an additional crosslinking step, it is possible to further strengthen the relief formed by engraving.

[Method for Manufacturing Flexographic Printing Plate Precursor]

The method for manufacturing a flexographic printing plate precursor of the present invention (hereinafter, also abbreviated as "precursor manufacturing method") is a method for manufacturing the above-described flexographic printing plate precursor according to the present invention, and the method includes a layer forming step of forming a relief forming layer by using a resin composition for laser engraving, a crosslinking step of crosslinking the relief forming layer to form the crosslinked relief forming layer, and an unevenness forming step of irradiating the crosslinked relief forming layer with laser light to form the uneven structure on the surface of the crosslinked relief forming layer, thereby obtaining the flexographic printing plate precursor.

The precursor manufacturing method is a method for producing a flexographic printing plate precursor used in a method for manufacturing a flexographic printing plate according to a second aspect of the present invention, which will be described later.

In addition, the layer forming step and the crosslinking step in the precursor manufacturing method are the same as the above-described steps in the first printing plate manufacturing method, and thus only the unevenness forming step will be described in detail below.

[Unevenness Forming Step]

The unevenness forming step is a step of irradiating the crosslinked relief forming layer crosslinked in the above crosslinking step with laser light to form the above-described uneven structure on the surface of the crosslinked relief forming layer, thereby obtaining the flexographic printing plate precursor.

That is, the unevenness forming step in the precursor manufacturing method is a step of performing the process of forming the uneven structure on the surface of the image area in the above-described engraving step over the entire surface of the crosslinked relief forming layer.

Therefore, in the unevenness forming step, the laser engraving method in the above-described engraving step can be appropriately adopted. However, for the reason that a groove having a LER in a range of 0.5 to 2.5 μm in a region of 30 μm in the longitudinal direction as in the above-described engraving step, in a case where the length of a groove which is formed by continuous irradiation with laser in the main scanning direction is set to A, and the length of a groove which is formed by continuous irradiation with laser in the sub-scanning direction is set to B at the time of forming the uneven structure (plurality of grooves), the uneven structure is preferably formed under the condition that A is three or more times longer than B, or the condition that only A is provided.

[Method for Manufacturing Flexographic Printing Plate (Second Aspect)]

A method for manufacturing a flexographic printing plate according to a second aspect of the present invention (hereinafter, also referred to as "second printing plate manufacturing method") is a method for manufacturing the above-described flexographic printing plate of the present invention, and the method includes performing laser engraving on the crosslinked relief forming layer of the flexographic printing plate precursor produced by the above-described method for manufacturing a precursor of the present invention to form the relief layer including the non-image area and the image area having the above-described uneven structure formed on the surface, thereby obtaining the flexographic printing plate.

Hereinafter, the laser engraving in the second printing plate manufacturing method will be described in detail.

[Laser Engraving]

The laser engraving in the second printing plate manufacturing method is a step of performing laser engraving on the crosslinked relief forming layer of the flexographic printing plate precursor produced by the above-described method for manufacturing a flexographic printing plate precursor of the present invention, that is, the crosslinked relief forming layer on which an uneven structure is already formed to engrave a portion which becomes a non-image area.

The laser engraving is not particularly limited and it is preferable to form a relief layer by performing engraving by irradiation with laser light corresponding to a desired image as in a known engraving step of the related art.

Regarding the method of laser engraving, the kind of laser to be used, and the like in the second printing plate manufacturing method, known methods of the related art can be appropriately adopted including those described in the above-described first printing plate manufacturing method.

In addition, in the second printing plate manufacturing method, as in the above-described first printing plate manufacturing method, a rinsing step, a drying step, and a post-crosslinking step may be performed after laser engraving, if required.

[Flexographic Printing Apparatus]

Next, the configuration of a flexographic printing apparatus (hereinafter, also simply referred to as "printing apparatus") using the flexographic printing plate according to the present invention will be described in detail. The flexographic printing apparatus has the same configuration as a flexographic printing apparatus of the related art except that the above flexographic printing plate is used.

Figure 7:
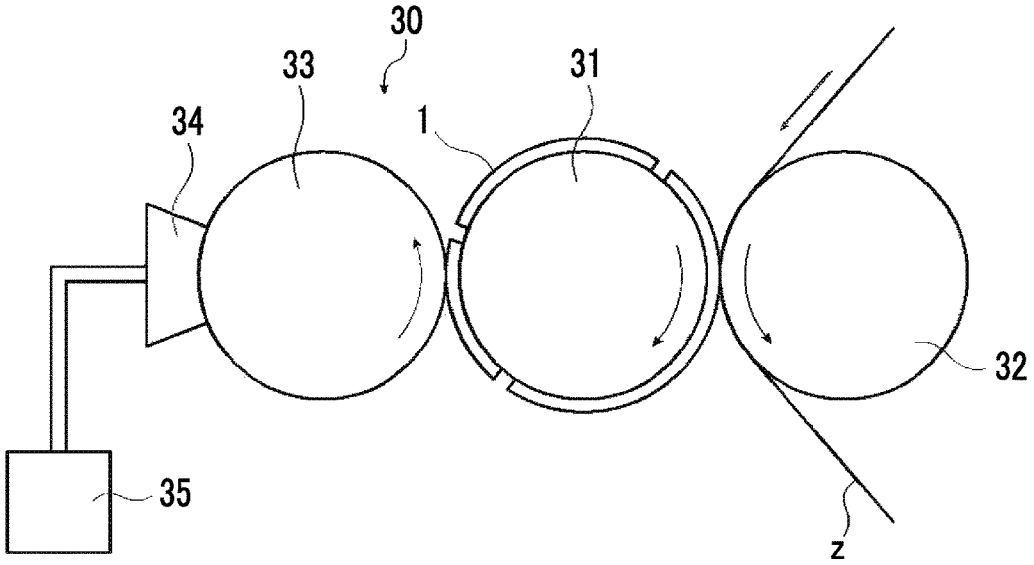
FIG. 7 is a view conceptually showing a main part of a flexographic printing apparatus using the flexographic printing plate according to the present invention.

FIG. 7 is a view conceptually showing the main part of a flexographic printing apparatus using the flexographic printing plate according to the present invention.

As shown in FIG. 7, a flexographic printing apparatus 30 has the flexographic printing plate 1, a drum (plate cylinder) 31, a transport roller (impression cylinder) 32, an anilox roller 33, a doctor chamber 34, and a circulation tank 35.

The drum 31 has a cylindrical shape, and the flexographic printing plate 1 is placed onto the peripheral surface thereof. While rotating, the drum 31 brings the flexographic printing plate 1 into contact with an object to be printed z.

The transport roller 32 is a roller constituting a transport portion (not shown in the drawing) which transports the object to be printed z along a predetermined transport path. The transport roller 32 is arranged such that the peripheral surface thereof faces the peripheral surface of the drum 31, and brings the object to be printed z into contact with the flexographic printing plate 1.

The drum 31 is arranged such that the rotation direction thereof becomes identical to the transport direction of the object to be printed z.

The anilox roller 33, the doctor chamber 34, and the circulation tank 35 are portions for supplying ink to the flexographic printing plate 1. The circulation tank 35 stores ink, and the ink in the circulation tank 35 is supplied to the doctor chamber 34 by a pump (not shown in the drawing). The doctor chamber 34 is arranged to come into close contact with the surface of the anilox roller 33 and holds ink in the inside thereof. The anilox roller 33 rotates in synchronization with the drum 31 in a state of abutting on the peripheral surface of the drum 31, such that the printing plate 1 is coated (supplied) with the ink in the doctor chamber 34.

While transporting the object to be printed z along a predetermined transport path, the flexographic printing apparatus 30 having the above configuration rotates the flexographic printing plate 1 placed onto the drum 31 and transfers the ink to the object to be printed z, thereby performing printing. That is, the rotation direction of the drum onto which the flexographic printing plate is placed becomes the printing direction.

The kind of the object to be printed used in the flexographic printing apparatus using the flexographic printing plate of the present invention is not particularly limited and various known objects to be printed used in general flexographic printing apparatuses, such as paper, films, and cardboards, can be used.

In addition, the kind of the ink used in the flexographic printing apparatus using the flexographic printing plate of the present invention is not particularly limited and various known inks used in general flexographic printing apparatuses, such as an aqueous ink, an ultra violet (UV) ink, an oil ink, and an electron beam (EB) ink, can be used.

EXAMPLES

Hereinafter, the present invention will be more specifically described based on Examples. Any materials, amount of use, ratio, details of processing, procedures of processing and the like shown in Examples may appropriately be modified without departing from the spirit of the present invention. Therefore, it is to be understood that the scope of the present invention should not be interpreted in a limited manner based on the specific examples shown below.

Example 1

<Preparation of Resin Composition A>

80 parts by mass of EPDM: MITSUI EPT1045 (ethylene-propylene-diene copolymer, ethylene content: 58% by mass, diene content: 5% by mass, kind of diene: dicyclopentadiene (DCPD), manufactured by Mitsui Chemicals, Inc.) as a polymer, 12 parts by mass of carbon black #45L (nitrogen adsorption specific surface area: 125 $m^2/g$, DBP absorption: 45 $cm^3/100$ g, manufactured by Mitsubishi Chemical Corporation) as a photothermal converting agent, and 5 parts by mass of PERCUMYL D40 (dicumyl peroxide (40% by mass), manufactured by NOF CORPORATION) as an organic peroxide were kneaded to prepare a resin composition A.

<Preparation of Flexographic Printing Plate Precursor>

The obtained resin composition A was crosslinked by heating at a pressure of 10 MPa and 160° C. for 20 minutes using a heating press machine (MP-WCL, manufactured by Toyo Seiki Seisaku-sho, Ltd.) and thus a flexographic printing plate precursor consisting of a crosslinked relief forming layer having a thickness of 1.14 mm was produced.

<Production of Flexographic Printing Plate>

A flexographic printing plate having an image area and a non-image area was formed by performing laser engraving on the crosslinked relief forming layer of the obtained flexographic printing plate precursor.

Specifically, engraving by irradiation with laser was performed using a laser engraving machine (1300S, manufactured by Hell Gravure Systems) under the conditions of a resolution of 2,540 dpi. Then, a cleaning agent (2% aqueous solution of JOY (registered trademark), manufactured by The Procter & Gamble Company) was dropped onto the plate and rubbed with a pig bristle brush, and the plate was washed with flowing water to remove the engraving residue.

Figure 8A:
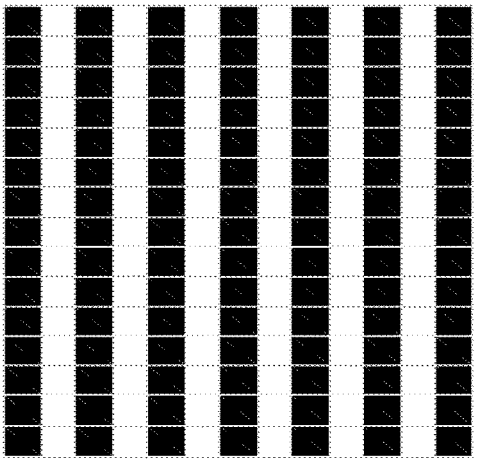
FIG. 8A is a view showing an image pattern (original image data) A used for flexographic printing plates produced in examples and comparative examples.
Figure 8B:
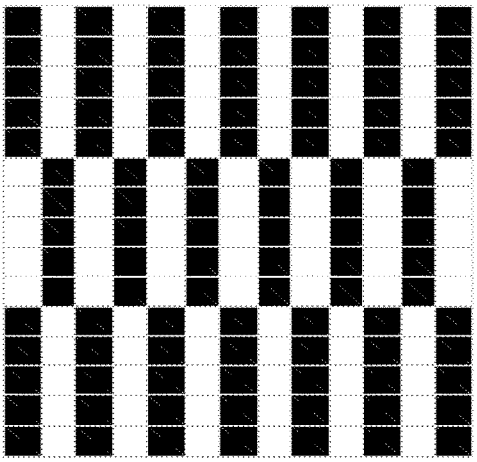
FIG. 8B is a view showing an image pattern (original image data) B used for a flexographic printing plate produced in an example.
Figure 8C:
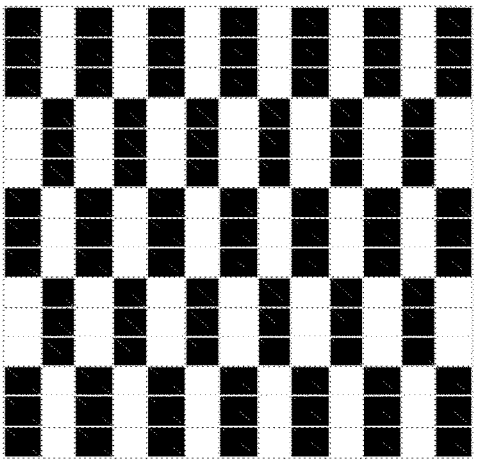
FIG. 8C is a view showing an image pattern (original image data) C used for a flexographic printing plate produced in an example.
Figure 8D:
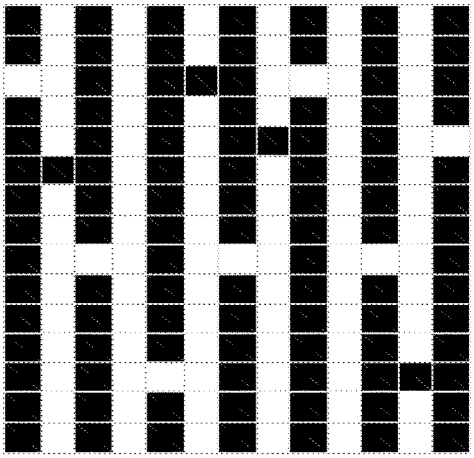
FIG. 8D is a view showing an image pattern (original image data) D used for a flexographic printing plate produced in an example.
Figure 8E:
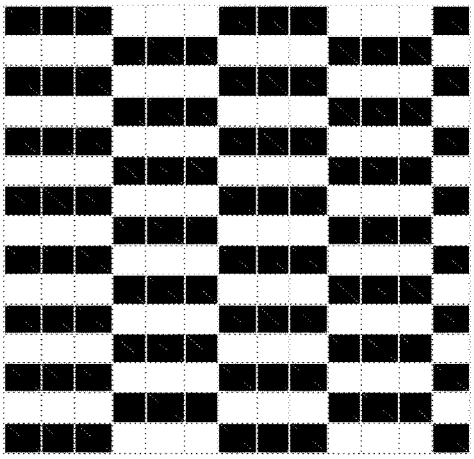
FIG. 8E is a view showing an image pattern (original image data) E used for flexographic printing plates produced in examples and comparative examples.
Figure 8F:
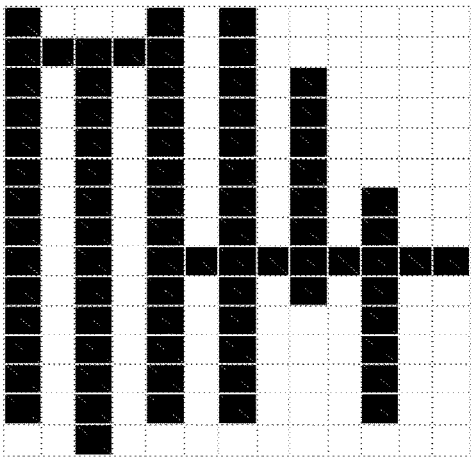
FIG. 8F is a view showing an image pattern (original image data) F used for a flexographic printing plate produced in an example.

Herein, for a pattern of the uneven structure in the image area, engraving was performed using an image pattern A shown in FIG. 8A (white: projecting portion, black: recessed portion) to form an image area having an uneven structure consisting of recessed portions and projecting portions shown in Table 1 below. In each image pattern shown in FIGS. 8A to 8F, 1 mass is 1 pixel (2540 dpi) and is about 10 μm.

The LER and LWR of the recessed portion, the ratio of the projecting portion, the width of the recessed portion and the projecting portion, and the depth of the recessed portion shown in Table 1 below are measured by the above-described measurement methods.

In addition, the light quantity Lv shown in Table 1 below refers to a set value of 8-bit gradation of the irradiation laser power (Depth Power) of the non-image area using a laser engraving machine (1300S, manufactured by Hell Gravure Systems), and refers to a set value in a case where the irradiation laser power of the non-image area is set to 255 Lv. A light quantity of 10 Lv corresponds to 10/255 the irradiation laser power of the non-image area.

In addition, regarding the engraving angle shown in Table 1 below, in a case where the angle of the recessed portions at the time of continuously drawing in the main scanning direction of laser was set to 0°, and the angle of recessed portions formed to be connected to each other by being irradiated with laser discontinuously in the sub-scanning direction was set to 90°, the angle of the recessed portion was defined as the engraving angle.

Examples 2 to 11 and Comparative Examples 1 to 14

Flexographic printing plates were manufactured in the same manner as in Example 1 except that the conditions in the laser engraving (light quantity, image pattern, and engraving angle) were changed to the conditions shown in Table 1 below.

In Table 1 below, regarding the image pattern, the image patterns shown in FIGS. 8B to F are respectively denoted as image patterns B to F.

Example 12

A resin composition B was prepared in the same manner as the preparation of the resin composition A except that carbon black #1000 (nitrogen adsorption specific surface area: 180 $m^2/g$, DBP absorption: 56 $cm^3/100$ g, manufactured by Mitsubishi Chemical Corporation) was used instead of carbon black #45L.

In addition, a flexographic printing plate was manufactured in the same manner as in Example 5 except that the resin composition B was used instead of the resin composition A.

Example 13

A resin composition C was prepared in the same manner as in the preparation of the resin composition A except that F-200 (nitrogen adsorption specific surface area: 51 $m^2/g$, DBP absorption: 180 $cm^3/100$ g, manufactured by ASAHI CARBON CO., LTD.) was used instead of carbon black #45L.

In addition, a flexographic printing plate was manufactured in the same manner as in Example 5 except that the resin composition C was used instead of the resin composition A.

Example 14

A resin composition D was prepared in the same manner as in the preparation of the resin composition A except that SEAST FM (nitrogen adsorption specific surface area: 42 $m^2/g$, DBP absorption: 160 $cm^3/100$ g, manufactured by Tokai Carbon Co., Ltd.) was used instead of carbon black #45L.

In addition, a flexographic printing plate was manufactured in the same manner as in Example 5 except that the resin composition D was used instead of the resin composition A.

Example 15

<Preparation of Resin Composition E>

A resin composition E was prepared in the same manner as in the preparation of the resin composition A except that syndiotactic 1,2-polybutadiene RB830 (manufactured by JSR Corporation) was used instead of EPDM, the amount of carbon black #45L to be formulated was changed to 9 parts by mass, and the amount of PERCUMYL D40 to be formulated was changed to 0.2 parts by mass.

<Preparation of Resin Composition F>

80 parts by mass of EPDM: MITSUI EPT1045 (ethylene-propylene-diene copolymer, ethylene content: 58% by mass, diene content: 5% by mass, kind of diene: dicyclopentadiene (DCPD), manufactured by Mitsui Chemicals, Inc.) as a polymer, 12 parts by mass of carbon black #45L (nitrogen adsorption specific surface area: 125 $m^2/g$, DBP absorption: 45 $cm^3/100$ g, manufactured by Mitsubishi Chemical Corporation) as a photothermal converting agent, and 5 parts by mass of PERCUMYL D40 (dicumyl peroxide (1% by mass), manufactured by NOF CORPORATION) were kneaded to prepare a resin composition F.

A flexographic printing plate was manufactured in the same manner as in Example 1 except that the flexographic printing plate precursor was produced in the following manner.

<Production of Flexographic Printing Plate Precursor>

The obtained resin composition A was crosslinked by heating at a pressure of 10 MPa and 160° C. for 20 minutes using a heating press machine (MP-WCL, manufactured by Toyo Seiki Seisaku-sho, Ltd.) and thus a crosslinked relief forming layer (underlayer) having a thickness of 1.14 mm was formed.

Next, a stainless steel sheet (spacer) having a thickness of 150 μm and the resin composition E were placed on the crosslinked relief forming layer (underlayer) and these materials were crosslinked at 180° C. for 10 minutes by heat pressing to form a crosslinked relief forming layer (interlayer) having a thickness of 150 μm.

Next, an aluminum sheet (spacer) having a thickness of 20 μm and the resin composition F were placed on the crosslinked relief forming layer (interlayer), these materials were crosslinked at 180° C. for 2 minutes by heat pressing, and a crosslinked relief forming layer (outermost layer) having a thickness of 20 μm was formed to manufacture a flexographic printing plate precursor.

[Evaluation]

The obtained flexographic printing plate was set in a printing machine (ILF-270-4F, manufactured by TAIYO KIKAI Ltd.), and printing was continuously performed at 40 m/min using an aqueous flexographic indigo (HYDRIC FCG 739, manufactured by Dainichiseika Color & Chemicals Mfg. Co., Ltd.) as an ink and Taiko OPP film FOS-AQ (manufactured by Futamura Chemical Co., Ltd.) as printing paper. The ink uniformity was compared based on the degree of ink attachment in the solid portion on the printed matter 1,000 m from the start of printing.

The evaluation for ink uniformity was performed by measuring the density of the solid portion on the obtained printed matter at three points with a portable reflective densitometer (manufactured by X-Rite, Incorporated) twice, and obtaining an average value of measurement values of a total of 6 measurements.

TABLE 1

| | | Laser engraving | | | Recessed portions (plurality of grooves) | | | | Projecting portions | | Solid |
|---|---|---|---|---|---|---|---|---|---|---|---|
| Table 1 | Resin composition | Light quantity Lv | Image pattern | Engraving angle (°) | Width μm | Depth μm | LER μm | LWR μm | Width μm | Ratio % | portion density |
| Example 1 | A | 10 | A | 0 | 10 | 12 | 1.0 | 1.2 | 5 | 32 | 1.83 |
| Example 2 | A | 10 | A | 0 | 19 | 12 | 1.0 | 1.2 | 13 | 40 | 1.89 |
| Example 3 | A | 10 | A | 0 | 19 | 12 | 1.0 | 1.6 | 22 | 53 | 1.82 |
| Example 4 | A | 5 | A | 0 | 16 | 6 | 1.0 | 1.4 | 6 | 28 | 1.83 |

TABLE 1-continued

| | | Laser engraving | | | Recessed portions (plurality of grooves) | | | | Projecting portions | | |
|---|---|---|---|---|---|---|---|---|---|---|---|
| Table 1 | Resin composition | Light quantity Lv | Image pattern | Engraving angle (°) | Width μm | Depth μm | LER μm | LWR μm | Width μm | Ratio % | Solid portion density |
| Example 5 | A | 15 | A | 0 | 17 | 14 | 1.0 | 1.4 | 8 | 31 | 1.90 |
| Example 6 | A | 20 | A | 0 | 22 | 25 | 1.0 | 1.2 | 2 | 8 | 1.86 |
| Example 7 | A | 10 | A | 0 | 17 | 14 | 0.6 | 1.0 | 8 | 32 | 1.95 |
| Example 8 | A | 10 | B | 10 | 18 | 14 | 1.4 | 1.8 | 9 | 34 | 1.89 |
| Example 9 | A | 10 | C | 30 | 18 | 14 | 2.5 | 4.0 | 9 | 33 | 1.77 |
| Example 10 | A | 15 | D | 0 | 17 | 14 | 1.3 | 1.9 | 8 | 31 | 1.87 |
| Example 11 | A | 10 | F | 0 | 10 | 12 | 2.5 | 3.9 | 5 | 41 | 1.84 |
| Example 12 | B | 15 | A | 0 | 17 | 14 | 1.0 | 1.3 | 8 | 31 | 1.84 |
| Example 13 | C | 15 | A | 0 | 17 | 14 | 1.0 | 1.4 | 8 | 31 | 1.84 |
| Example 14 | D | 15 | A | 0 | 17 | 14 | 1.0 | 1.5 | 8 | 31 | 1.84 |
| Example 15 | F/E/A | 20 | A | 0 | 22 | 20 | 1.1 | 1.7 | 15 | 41 | 1.92 |
| Comparative Example 1 | A | 10 | A | 0 | 20 | 12 | 1.1 | 1.3 | 39 | 66 | 1.66 |
| Comparative Example 2 | A | 28 | A | 0 | 24 | 27 | 1.3 | 1.6 | 1 | 4 | 1.73 |
| Comparative Example 3 | A | 30 | A | 0 | 24 | 31 | 1.3 | 1.6 | 1 | 4 | 1.70 |
| Comparative Example 4 | A | 25 | A | 0 | 19 | 27 | 1.0 | 1.3 | 18 | 49 | 1.40 |
| Comparative Example 5 | A | 25 | A | 0 | 16 | 27 | 1.0 | 1.3 | 44 | 73 | 1.27 |
| Comparative Example 6 | A | 5 | A | 0 | 14 | 10 | 1.0 | 1.3 | 44 | 76 | 1.60 |
| Comparative Example 7 | A | 10 | E | 60 | 10 | 12 | 3.0 | 5.2 | 5 | 32 | 1.63 |
| Comparative Example 8 | A | 10 | E | 60 | 19 | 12 | 3.0 | 5.2 | 13 | 40 | 1.69 |
| Comparative Example 9 | A | 10 | E | 60 | 19 | 12 | 3.0 | 5.2 | 22 | 53 | 1.59 |
| Comparative Example 10 | A | 5 | E | 60 | 16 | 6 | 3.0 | 5.2 | 6 | 28 | 1.65 |
| Comparative Example 11 | A | 15 | E | 60 | 17 | 14 | 3.0 | 5.2 | 8 | 31 | 1.66 |
| Comparative Example 12 | A | 15 | E | 90 | 17 | 14 | 3.0 | 5.2 | 7.7 | 31 | 1.10 |
| Comparative Example 13 | A | 4 | A | 0 | 10 | 3 | 3.3 | 6.0 | 10 | 50 | 1.70 |
| Comparative Example 14 | A | 10 | A | 50 | 12 | 15 | 2.6 | 3.9 | 10 | 45 | 1.70 |

As shown in Table 1, it was found that in the flexographic printing plates in which the ratio of the projecting portion was outside a range of 5% to 60%, the density of the solid portion was low and the ink transferability was deteriorated (Comparative Examples 1 to 3, 5, and 6).

It was also found that in a case where the depth of the recessed portion was outside a range of 5 to 25 μm, the density of the solid portion was low and the ink transferability was deteriorated (Comparative Examples 2 to 5 and 13).

In addition, it was found that in a case where the LER of the groove constituting the recessed portion was more than 2.5 μm, the density of the solid portion was low and the ink transferability was deteriorated (Comparative Examples 7 to 14).

On the other hand, it was found that in a case where printing plates had an uneven structure in which the LER of the groove constituting the recessed portion was in a range of 0.5 to 2.5 μm, the depth of the recessed portion and the ratio of the projecting portion were in predetermined ranges, was provided, the density of the solid portion was high and the ink transferability was good (Examples 1 to 15).

In addition, comparing Examples 1 and 5, it was found that in Example 15 in which the relief forming layer was composed of three layers, the density of the solid portion was high and the ink transferability was better.

EXPLANATION OF REFERENCES

1: flexographic printing plate
2: relief layer
3: image area
4: non-image area
5: recessed portion
6: projecting portion
D: depth of recessed portion
W: width of recessed portion
X: center line
30: flexographic printing apparatus
31: drum
32: transport roller
33: anilox roller
34: doctor chamber
35: circulation tank
60: calender roll
62*a* to 62*d*: first roller to fourth roller
70: kneaded product
71: uncured layer
z: object to be printed

What is claimed is:

1. A flexographic printing plate comprising:

a relief layer including a non-image area and an image area having an uneven structure formed on a surface, wherein the uneven structure is composed of recessed portions consisting of a plurality of grooves and projecting portions other than recessed portions, each of the plurality of grooves has a length of at least 30 μm, all of the plurality of grooves are grooves having a line edge roughness in a range of 0.5 to 2.5 μm in a region of 30 μm of the groove in a longitudinal direction, a depth of the recessed portion is 5 to 25 μm, and a ratio of the projecting portion is 5% to 60% of a geometric area of the uneven structure.

2. The flexographic printing plate according to claim 1, wherein all of the plurality of grooves are grooves having a line width roughness in a range of 0.8 to 4.0 μm in a region of 30 μm of the groove in a longitudinal direction.

3. The flexographic printing plate according to claim 2, wherein the plurality of grooves are grooves that are arranged parallel with each other or radially.

4. A method for manufacturing the flexographic printing plate having a relief layer including a non-image area and an image area having an uneven structure formed on a surface according to claim 3, the method comprising:

a layer forming step of forming a relief forming layer by using a resin composition for laser engraving;

a crosslinking step of crosslinking the relief forming layer to obtain a flexographic printing plate precursor having a crosslinked relief forming layer; and an engraving step of performing laser engraving on the crosslinked relief forming layer to form the relief layer including the non-image area and the image area having the uneven structure formed on the surface, thereby obtaining the flexographic printing plate.

5. A method for manufacturing the flexographic printing plate having a relief layer including a non-image area and an image area having an uneven structure formed on a surface according to claim 3, the method comprising:

performing laser engraving on a crosslinked relief forming layer of a flexographic printing plate precursor produced by the method for manufacturing the flexographic printing plate precursor to form the relief layer including the non-image area and the image area having the uneven structure formed on the surface, thereby obtaining the flexographic printing plate.

6. A method for manufacturing the flexographic printing plate having a relief layer including a non-image area and an image area having an uneven structure formed on a surface according to claim 2, the method comprising:

a layer forming step of forming a relief forming layer by using a resin composition for laser engraving;

a crosslinking step of crosslinking the relief forming layer to obtain a flexographic printing plate precursor having a crosslinked relief forming layer; and an engraving step of performing laser engraving on the crosslinked relief forming layer to form the relief layer including the non-image area and the image area having the uneven structure formed on the surface, thereby obtaining the flexographic printing plate.

7. A method for manufacturing the flexographic printing plate having a relief layer including a non-image area and an image area having an uneven structure formed on a surface according to claim 2, the method comprising:

performing laser engraving on a crosslinked relief forming layer of a flexographic printing plate precursor produced by the method for manufacturing the flexographic printing plate precursor to form the relief layer including the non-image area and the image area having the uneven structure formed on the surface, thereby obtaining the flexographic printing plate.

8. The flexographic printing plate according to claim 1, wherein the plurality of grooves are grooves that are arranged parallel with each other or radially.

9. A method for manufacturing the flexographic printing plate having a relief layer including a non-image area and an image area having an uneven structure formed on a surface according to claim 8, the method comprising:

a layer forming step of forming a relief forming layer by using a resin composition for laser engraving;

a crosslinking step of crosslinking the relief forming layer to obtain a flexographic printing plate precursor having a crosslinked relief forming layer; and an engraving step of performing laser engraving on the crosslinked relief forming layer to form the relief layer including the non-image area and the image area having the uneven structure formed on the surface, thereby obtaining the flexographic printing plate.

10. A method for manufacturing the flexographic printing plate having a relief layer including a non-image area and an image area having an uneven structure formed on a surface according to claim 8, the method comprising:

performing laser engraving on a crosslinked relief forming layer of a flexographic printing plate precursor produced by the method for manufacturing the flexographic printing plate precursor to form the relief layer including the non-image area and the image area having the uneven structure formed on the surface, thereby obtaining the flexographic printing plate.

11. A method for manufacturing the flexographic printing plate having a relief layer including a non-image area and an image area having an uneven structure formed on a surface according to claim 1, the method comprising:

a layer forming step of forming a relief forming layer by using a resin composition for laser engraving;

a crosslinking step of crosslinking the relief forming layer to obtain a flexographic printing plate precursor having a crosslinked relief forming layer; and an engraving step of performing laser engraving on the crosslinked relief forming layer to form the relief layer including the non-image area and the image area having the uneven structure formed on the surface, thereby obtaining the flexographic printing plate.

12. A method for manufacturing the flexographic printing plate having a relief layer including a non-image area and an image area having an uneven structure formed on a surface according to claim 1, the method comprising:

performing laser engraving on a crosslinked relief forming layer of a flexographic printing plate precursor produced by the method for manufacturing the flexographic printing plate precursor to form the relief layer including the non-image area and the image area having the uneven structure formed on the surface, thereby obtaining the flexographic printing plate.

13. A flexographic printing plate precursor comprising:

a crosslinked relief forming layer having an uneven structure formed on a surface, wherein the uneven structure is composed of recessed portions consisting of a plurality of grooves and projecting portions other than the recessed portions, each of the plurality of grooves has a length of at least 30 μm, all of the plurality of grooves are grooves having a line edge roughness in a range of 0.5 to 2.5 μm in a region of 30 μm of the groove in a longitudinal direction, a depth of the recessed portion is 5 to 25 μm, and a ratio of the projecting portion is 5% to 60% of a geometric area of the uneven structure.

14. The flexographic printing plate precursor according to claim 13, wherein all of the plurality of grooves are grooves having a line width roughness in a range of 0.8 to 4.0 μm in a region of 30 μm of the groove in a longitudinal direction.

15. The flexographic printing plate precursor according to claim 14, wherein the plurality of grooves are grooves that are arranged parallel with each other or radially.

16. A method for manufacturing the flexographic printing plate precursor having a crosslinked relief forming layer having an uneven structure formed on a surface according to claim 15, the method comprising:

a layer forming step of forming a relief forming layer by using a resin composition for laser engraving;

a crosslinking step of crosslinking the relief forming layer to form the crosslinked relief forming layer; and an unevenness forming step of irradiating the crosslinked relief forming layer with laser light to form the uneven structure on the surface of the crosslinked relief forming layer, thereby obtaining the flexographic printing plate precursor.

17. A method for manufacturing the flexographic printing plate precursor having a crosslinked relief forming layer having an uneven structure formed on a surface according to claim 14, the method comprising:

a layer forming step of forming a relief forming layer by using a resin composition for laser engraving;

a crosslinking step of crosslinking the relief forming layer to form the crosslinked relief forming layer; and an unevenness forming step of irradiating the crosslinked relief forming layer with laser light to form the uneven structure on the surface of the crosslinked relief forming layer, thereby obtaining the flexographic printing plate precursor.

18. A method for manufacturing the flexographic printing plate precursor having a crosslinked relief forming layer having an uneven structure formed on a surface according to claim 13, the method comprising:

a layer forming step of forming a relief forming layer by using a resin composition for laser engraving;

a crosslinking step of crosslinking the relief forming layer to form the crosslinked relief forming layer; and an unevenness forming step of irradiating the crosslinked relief forming layer with laser light to form the uneven structure on the surface of the crosslinked relief forming layer, thereby obtaining the flexographic printing plate precursor.

* * * * *